US006022188A

United States Patent [19]

Bancalari

[11] Patent Number: 6,022,188

[45] Date of Patent: Feb. 8, 2000

[54] AIRFOIL

[75] Inventor: Eduardo Bancalari, Orlando, Fla.

[73] Assignee: Siemens Westinghouse Power Corporation, Orlando, Fla.

[21] Appl. No.: 08/970,574

[22] Filed: Nov. 14, 1997

Related U.S. Application Data

[63] Continuation-in-part of application No. 08/738,566, Oct. 28, 1996, abandoned.

[51] Int. Cl.[7] ..... F04D 29/38

[52] U.S. Cl. ..... 415/115; 415/116; 415/181

[58] Field of Search ..... 415/115, 116, 415/181

[56] References Cited

U.S. PATENT DOCUMENTS

| | | | |
|---|---|---|---|
| 1,539,395 | 5/1925 | Losel . | |
| 2,110,679 | 3/1938 | Robinson | 415/181 |
| 3,246,469 | 4/1966 | Moore . | |
| 3,346,235 | 10/1967 | Papst . | |
| 4,229,140 | 10/1980 | Scott | 415/115 |
| 5,221,181 | 6/1993 | Ferleger et al. . | |
| 5,227,549 | 7/1993 | Chen et al. . | |
| 5,228,833 | 7/1993 | Schonenberger et al. | 415/181 |
| 5,352,092 | 10/1994 | Ferleger et al. . | |
| 5,382,133 | 1/1995 | Moore et al. . | |
| 5,577,889 | 11/1996 | Terazaki et al. | 415/115 |

FOREIGN PATENT DOCUMENTS

| | | |
|---|---|---|
| 0466501A2 | 1/1992 | European Pat. Off. . |
| 0520288A1 | 12/1992 | European Pat. Off. . |
| 2417640 | 9/1979 | France . |
| 546503 | 3/1946 | United Kingdom . |

OTHER PUBLICATIONS

Patent Abstracts Of Japan, vol. 010, No. 295 (M–523), Oct. 7, 1986 & JP 61 108805 A (Hitachi Ltd), May 27,1986.

R.A. Novak et al, "A Nearly Three–Dimensional Intrablade Computing System for Turbomachinery", Transactions of the American Society Of Mechanical Engineers, Series I: Journal Of Fluids Engineering, vol. 99, No. 3, Mar. 1977, pp. 154–166.

*Primary Examiner*—John Kwon

*Attorney, Agent, or Firm*—Eckert Seamans Cherin & Mellott, LLC

[57] ABSTRACT

An airfoil for a combustion turbine comprising a leading edge, a trailing edge, and an airfoil portion defined therebetween is provided. The airfoil has an axial chord length. The airfoil portion has an accelerating flow section and a decelerating flow section. The accelerating flow section is formed such that a gas flow continues to accelerate for over more than one half of the axial chord length such that a flow boundary layer remains substantially attached along the decelerating section of the airfoil.

7 Claims, 7 Drawing Sheets

AIRFOIL

This application is a continuation-in-part of application Ser. No. 08/738,566 filed Oct. 28, 1996, now abandoned.

FIELD OF THE INVENTION

The present invention relates to airfoils for combustion turbines. More specifically, the present invention relates to an improved airfoil for use in all stages of a combustion turbine in which the airfoil has a configuration that reduces boundary layer losses and allows the airfoil to be more efficiently film cooled.

DESCRIPTION OF THE PRIOR ART

Conventional combustion turbines comprise a compressor section, a combustion section, a turbine section, and turbine section airfoils, which include blades and vanes. Additionally, an annular flow path for directing a working fluid through the compressor section, combustion section, and turbine section is provided. The compressor section is provided to add enthalpy to the working fluid. Combustible fuel is added to the compressed working fluid in the combustion section and then combusted. The combustion of this mixture produces a hot, high velocity gas which is exhausted and directed by turbine vanes to impinge upon turbine blades within the turbine section. The turbine blades then rotate a shaft that is coupled to the compressor section to drive the compressor to compress more working fluid. Additionally, the turbine is used to power an external load.

The gas flow path of the combustion turbine is formed by a stationary cylinder and a rotor. The stationary vanes are attached to the cylinder in a circumferential array and extend inward into the hot, high velocity gas flow path. Similarly, the rotating blades are attached to the rotor in a circumferential array and extend outward into the hot, high velocity gas flow path. The stationary vanes and rotating blades are arranged in alternating rows so that a row of vanes and the immediately downstream row of blades form a stage. The vanes serve to direct the flow of hot, high velocity gas so that it enters the downstream row of blades at the correct angle. The blade airfoils extract energy from the hot, high velocity gas, thereby developing the power necessary to drive the rotor and the load attached to it.

The amount of energy extracted by each stage depends on the size and shape of the vane and blade airfoils, as well as the quantity of vanes and blades in the stage. Thus, the shapes of the airfoils are an extremely important factor in the thermodynamic performance of the turbine and determining the geometry of the airfoils is a vital portion of the turbine design.

As the hot, high velocity gas flows through the turbine its pressure drops through each succeeding stage until the desired discharge pressure is achieved. Thus, the gas flow properties—that is, temperature, pressure, and velocity—vary from stage to stage as the hot, high velocity gas expands through the flow path. Consequently, each stage employs vanes and blades having an airfoil shape that is optimized for the gas flow conditions associated with that stage. It is noted that within a given row the airfoils are identical.

Since the turbine vane and blade airfoils are exposed to extremely high temperature gas discharging from the combustion section, it is of the utmost importance to provided a means for cooling the airfoils. Typically, combuster shell or compressor bleed air is used as the source of cooling the airfoils. Additionally, the airfoils may have perforations which allow cooling air to flow to the outer surface of the airfoil thereby creating a cooling film. This cooling film is conventionally provided upstream of the throat of the airfoil and thereby requiring a substantially large amount of flow to cool the trailing edge of the airfoil. A drawback to all cooling systems is the reduced efficiency of the turbine engine as a result of the diversion of working fluid from the compressor section. Another drawback to many cooling systems is that the cooling film is only effective for limited distances along the airfoil because the cooling fluid gets mixed in with the main hot, high velocity gas flow. Another drawback of many cooling systems is that the cooling film is ejected into the flow field at a point along the suction side of each airfoil which potentially causes flow separation. It would, therefore, be desirable to provide an airfoil that is easier to cool. It would also be desirable to provide an airfoil that reduces boundary layer profile losses.

Generally, the major thermodynamic losses in either a vane or blade airfoil row occur due to profile losses as the gas flows over the airfoil surface and secondary losses as the flow is mixed thru the annulus. Profile losses are minimized by shaping the vane and blade airfoil.

The difficulty associated with designing combustion turbine blade and vane airfoils is exacerbated by the fact that the airfoil shape determines, in large part, the mechanical characteristics of the airfoil—such as its stiffness and resonant frequencies—as well as the thermodynamic performance of the airfoil. These considerations impose constraints on the choice of airfoil shape. Thus, of necessity, the optimum airfoil shape for a given row is a matter of compromise between its mechanical, heat transfer and aerodynamic properties.

SUMMARY OF THE INVENTION

Accordingly, it is the general object of the current invention to provide an airfoil for both a combustion turbine blade and vane. The airfoil comprises a leading edge, a trailing edge, and an airfoil portion defined therebetween. The airfoil has an axial chord length. The point of maximum velocity along the airfoil is located downstream of the throat between two adjacent airfoils. Film cooling perforations are formed in the suction side surface at a point downstream of the midpoint of the axial chord length and downstream of the throat and within the accelerating flow section for injecting cooling air into the accelerating gas flow around the airfoil. The airfoil suction side portion has an accelerating flow section and a decelerating flow section. The accelerating flow section is formed such that a gas flow continues to accelerate for over more than one half of the axial chord length such that a flow boundary layer remains attached along the decelerating section of the airfoil.

DESCRIPTION OF THE PREFERRED EMBODIMENT

Figure 1:
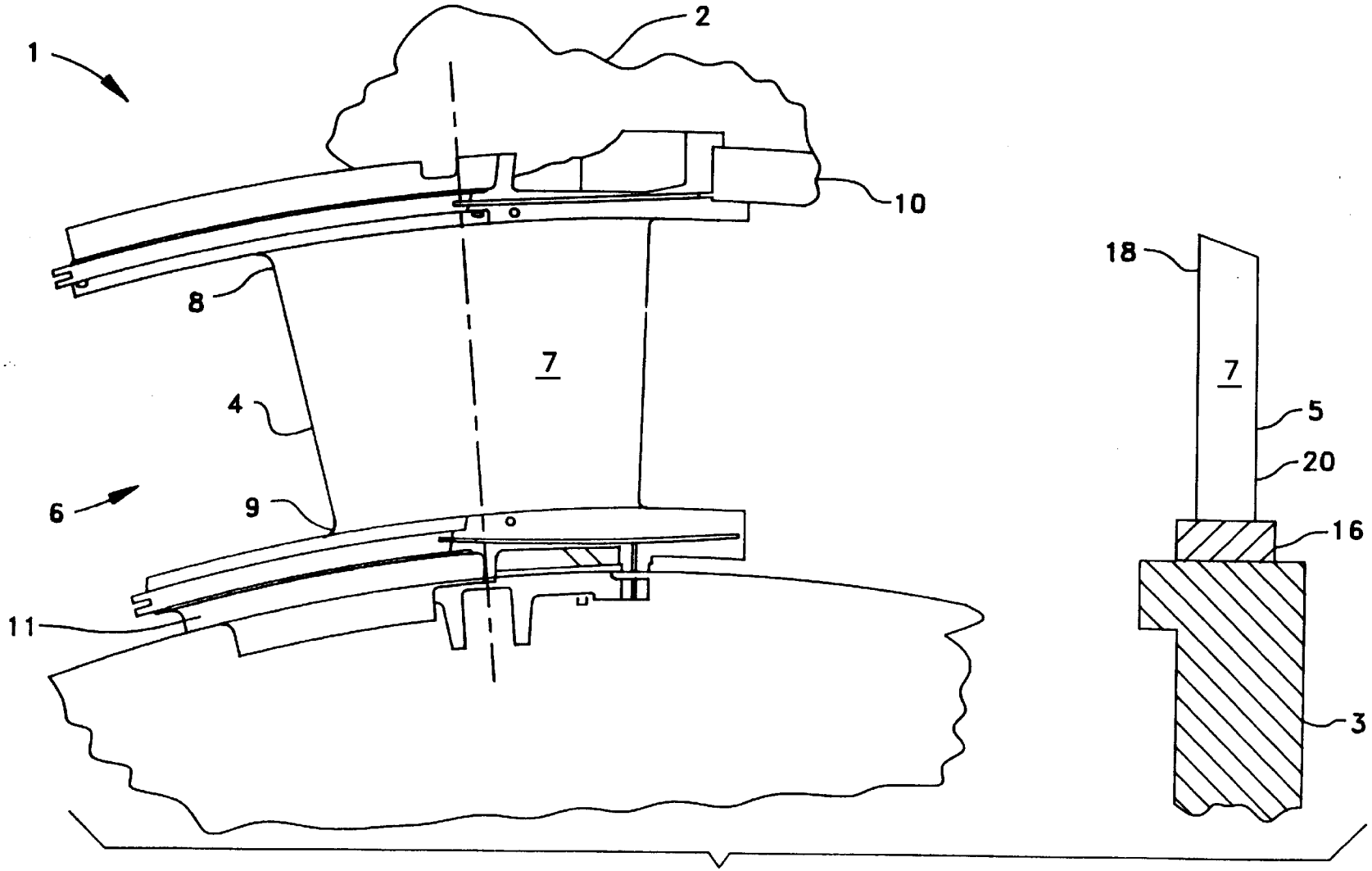
FIG. 1 is a portion of a longitudinal cross-section through a combustion turbine in the vicinity of the first stage in the turbine containing a row of vanes according to the current invention.

Referring to the drawings, all common or similar parts of the airfoil illustrated are designated by the same reference numeral.

FIG. 1 shows a cross-section of a portion of a combustion turbine 1. The hot high velocity gas flow path of the combustion turbine 1 is formed by a stationary cylinder 2 and a rotor 3. The axis of rotation of the rotor defines the axial direction. A row of blades 5 are attached to the periphery of the rotor 3 and extend radially outward into the flow path in a circumferential array. A row of vanes 4 are attached to the cylinder 2 and extend radially inward in a circumferential array. The vanes 4 receive the gas flow 6 from an upstream combustion section (not shown) and direct the gas flow to the downstream row of blades 5 so that the gas enters the blade row at the correct angle.

Vane 4 comprises an outer shroud 10 (by which it is affixed to the cylinder 2), an inner shroud 11, and the improved airfoil portion 7 extending in the radial direction between the inner shroud 11 and outer shroud 10. Each vane 4 has tip portion 8 that is attached to the outer shroud 10 and a hub portion 9 that is attached to the inner shroud 11. The radial height H of the airfoil portion 7 is defined between the tip 8 and hub 9 portions. In addition, each airfoil portion 7 has a leading edge 13 and a trailing edge 14.

Blade 5 comprises an airfoil portion 7. The blade 5 is attached to a platform 16 which is, in turn, attached to the rotor 3. The blade 5 airfoil 7 and vane 4 airfoil 7 each have a leading edge 18 and a trailing edge 19.

In accordance with the present invention, the improved airfoil portion 7 may be incorporated with either the vane 4 or blade 5, depending on the specific combustion turbine that is employed, and provide the same advantages and benefits by improving gas flow over the airfoil, and airfoil cooling capabilities, thereby improving the efficiency of the combustion turbine. It is noted, however, that the discussion that follows addresses only the airfoil portion 7 as applied to a vane 4.

Figure 2:
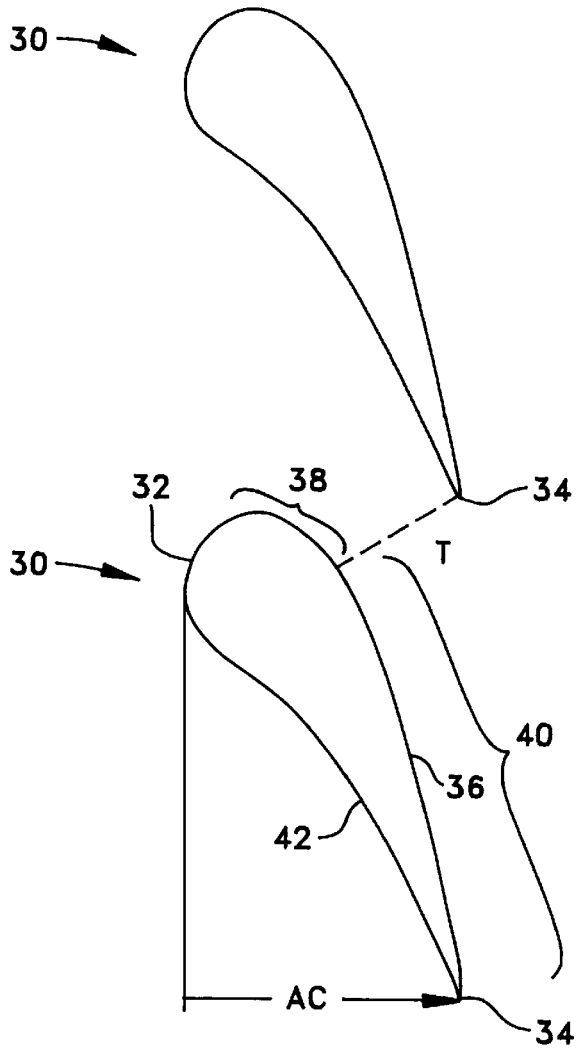
FIG. 2 PRIOR ART
FIG. 2 illustrates two prior art vane airfoils adjacent mounted in a combustion turbine.

Referring to FIG. 2, two prior art vanes 20 incorporating airfoil portion 21 are shown aligned in a conventional manner in a combustion turbine. Each airfoil portion 21 is defined by a leading edge 22 and trailing edge 24. Each airfoil portion 21 comprises a convex suction surface section 26 having an accelerating flow section 28 and a decelerating flow section 30, and a concave pressure surface section 32. The accelerating flow section 28 is that portion along the suction surface section 26 upon which the flow continues to accelerate. The decelerating flow section 30 is that portion along the suction surface upon which the flow continues to decelerate. The width, or axial chord length, of the vane 20 refers to the distance from the leading edge 22 to the trailing edge 24 in the axial direction, and is referred to as "AC". The throat portion is the shortest distance between the trailing edge 24 of one vane to the suction surface 26 of the adjacent blade and is indicated as "T". The length of the acceleration flow section 28 and deceleration flow section 30 are measured along the axial chord length.

Figure 3:
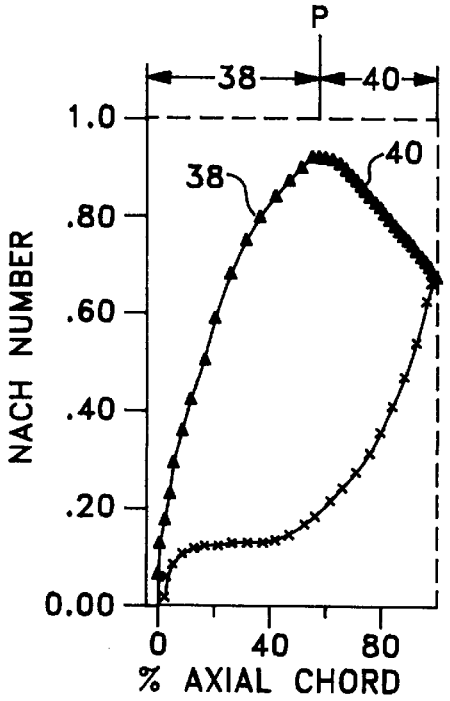
FIG. 3 PRIOR ART
FIG. 3 is a graph illustrating the flow characteristic of the prior art vane airfoils under specific flow conditions.

Referring to FIG. 3, the flow characteristics produced by the vane 20 and airfoil portion 21 under a specified environment are indicated. As shown in the graph, the accelerating flow section 28 and decelerating flow section 30 extend for approximately 50% of the axial chord length. As shown, the flow continues to accelerate along the accelerating flow section 28 for approximately 50% of the axial chord length until reaching a Mach Number of approximately 0.90 at a point P just upstream of the throat T. After this point P, the flow begins to decelerate along the decelerating flow section 30 for approximately 50% of the axial chord length until reaching the trailing edge 24. The injection of a stream of cooling air in an accelerating flow section of an airfoil will not cause the flow over the airfoil to become separated from the airfoil, rather, the mass flow over the airfoil including the cooling air will remain attached. Injection of a stream of cooling air in a decelerating flow section of an airfoil is likely to cause the flow over the airfoil to become separated, thereby greatly reducing the effectiveness of the injected cooling air. Also shown in the graph are the flow characteristics along the pressure surface 32.

These vanes 20 experience moderate boundary layer growth along the accelerating flow section 28 just upstream of the throat T. The boundary layer continues to grow at an accelerated rate along the decelerating flow section 30 for approximately 50% of the remaining axial chord length AC. The point P where the flow begins to decelerate from the suction surface 26 is also the maximum film cooling point of the vane 20. The maximum cooling point is the farthest point downstream where a cooling film can be ejected before possible flow separation occurs along the suction surface 26 and where the cooling film substantially begins being mixed in with the main hot, high velocity gas flow.

Figure 4:
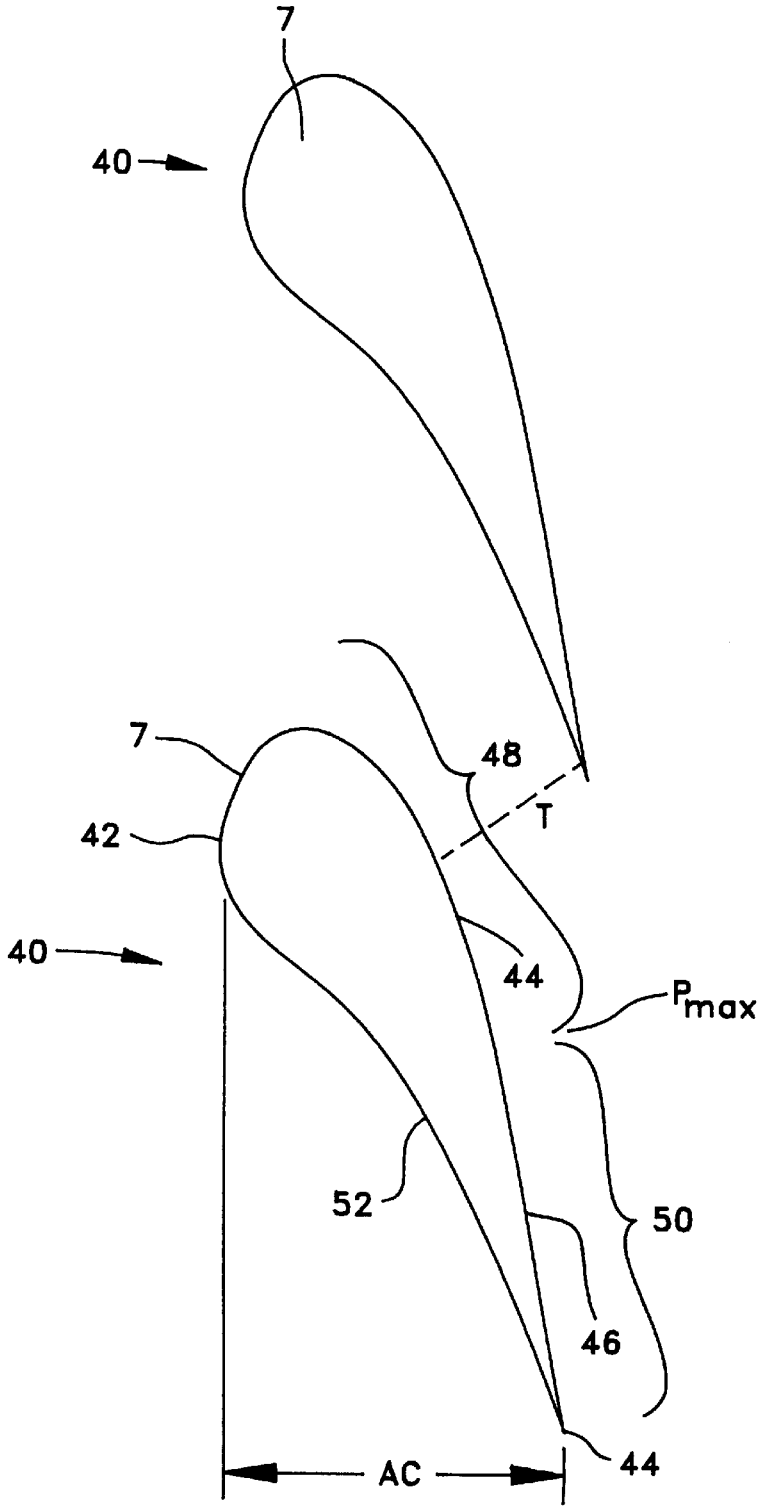
FIG. 4 PRIOR ART
FIG. 4 shows two adjacent vane airfoils in accordance with the present invention aligned within a combustion turbine.

Referring to FIG. 4, two vanes 40 with airfoil portions 7 in accordance with the present invention are shown adjacently aligned within a combustion turbine. Preferably, each airfoil portion 7 is defined by a leading edge 42 and trailing edge 44, and comprises a convex suction surface section 46 having an accelerating flow section 48 and a decelerating flow section 50, and a concave pressure section 52. The width, or axial chord, of the vane 40 and is referred to as "AC". The throat portion is indicated as "T". As shown, the accelerating flow section 48 extends downstream of the throat T.

Figure 5:
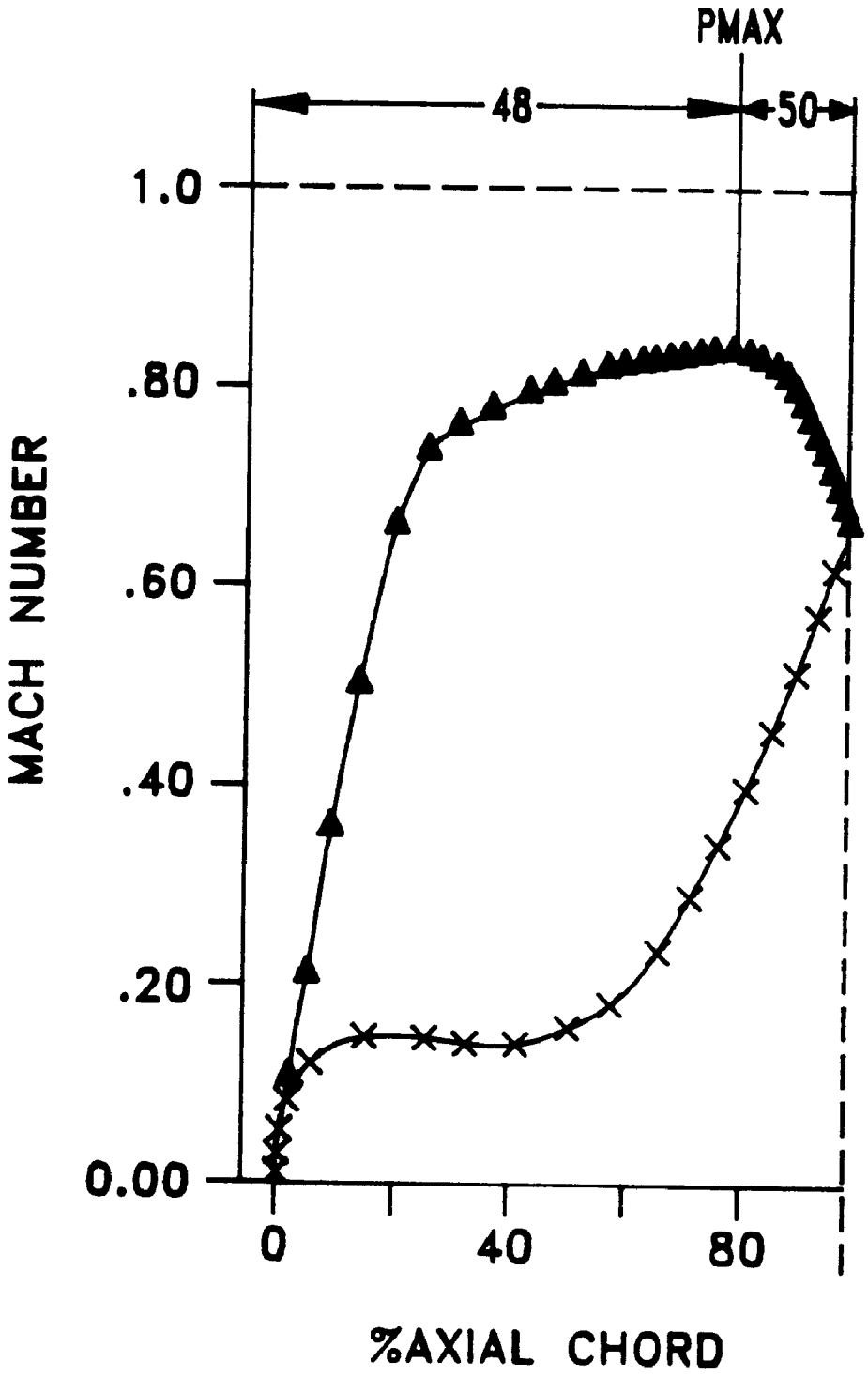
FIG. 5 is a graph illustrating particular flow characteristics of the vane airfoil under the same conditions as the prior art vane airfoils shown in FIGS. 2 and 3.

Referring to FIG. 5, the flow characteristics produced under the same conditions as the conventional vane 20 discussed above is provided for comparison. As indicated in the graph, the flow continues to accelerate along the accelerating flow section 48 for approximately 80% of the axial chord length until reaching a Mach Number of approximately 0.85 at a point $P_{max}$ substantially downstream of the throat before decelerating along the remaining approximate 20% of the decelerating flow section 50. The airfoil portion 7 accelerating flow section 48 enables the flow boundary layer to remain relatively small for a relatively longer period before larger boundary layer losses occur along the decelerating flow section 50. A preferred location for one of the film cooling perforations 60 is immediately upstream of point $P_{max}$, thereby avoiding the possible separation of the flow over the airfoil caused by the ejection of the cooling flow, while minimizing the distance between the ejection point and the trailing edge 44 of the airfoil 70. One or a plurality of additional perforations 60 may be located farther upstream of this preferred location. The selection of the specific distance between the point $P_{max}$ and the location of the first perforation 60 immediately upstream would take into account normal design and manufacturing tolerances as known by one skilled in the art of designing and manufacturing turbine blades and vanes, and may, for instance be a millimeter or a few millimeters or more. Additionally, the point $P_{max}$ is the maximum film cooling point where the cooling film may be ejected before excessive boundary layer growth occurs.

Figure 6:
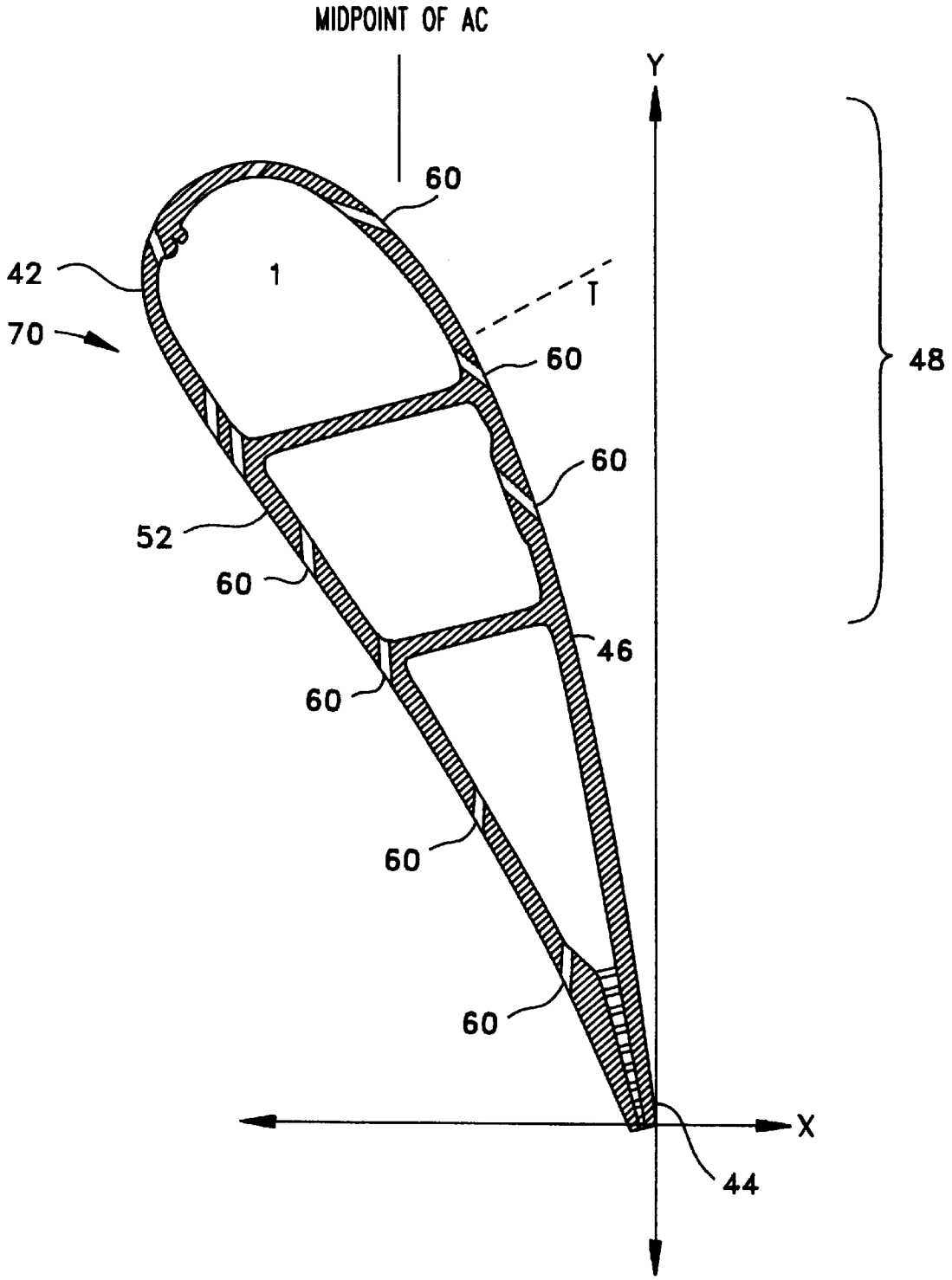
FIG. 6 illustrates the vane shown in FIG. 4 with cooling perforations formed in the airfoil suction surface acceleration section.

FIG. 6 shows vane 70 and airfoil portion 7 with film cooling perforations 60 formed substantially upstream of the trailing edge 44 and at other locations along the airfoil 7. The perforations 60 enable a cooling film to be ejected into an accelerating flow along the accelerating flow section 48 to cool the airfoil portion 7. The cooling film remains attached along the suction surface 46 for a longer period and, therefore, less cooling film from the compressor must be directed to cool the vane 70. The airfoil portion 7 also allows the cooling film to be ejected into the accelerating flow field without inducing flow separation. These flow characteristics, in turn, improve the efficiency of the combustion turbine.

Figure 9:
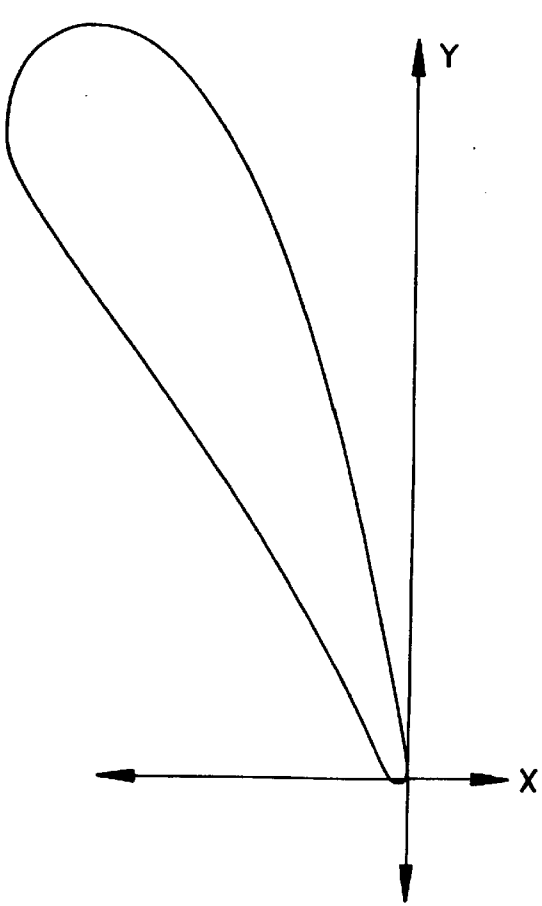
FIGS. 7–9 are cross-sections of the airfoil shown in FIG. 4 at various radial locations—the hub, mid-height, and tip regions, respectively.
Figure 8:
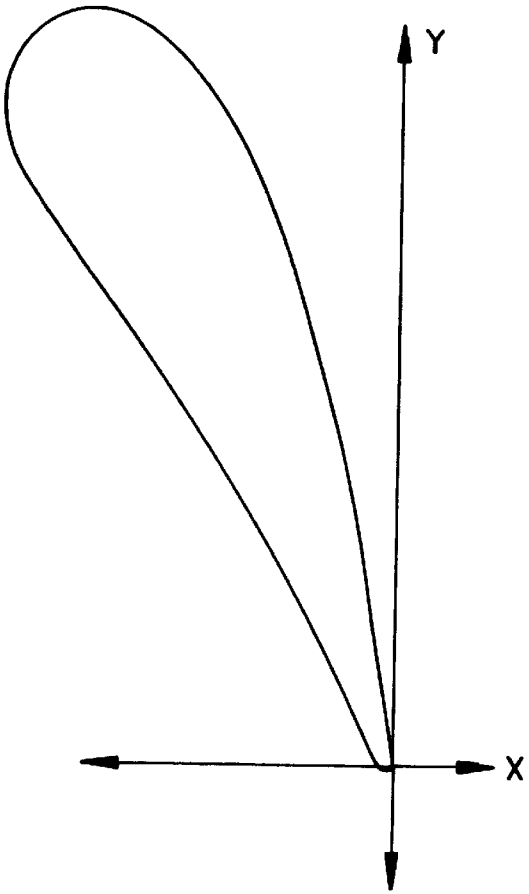

An exemplary embodiment of the airfoil 7 in accordance with the present invention as shown in FIG. 6 is defined by the dimensions and coordinates listed in Tables I through III. Various cross-sections of the exemplary embodiment are shown in FIGS. 7–9.

Figure 7:
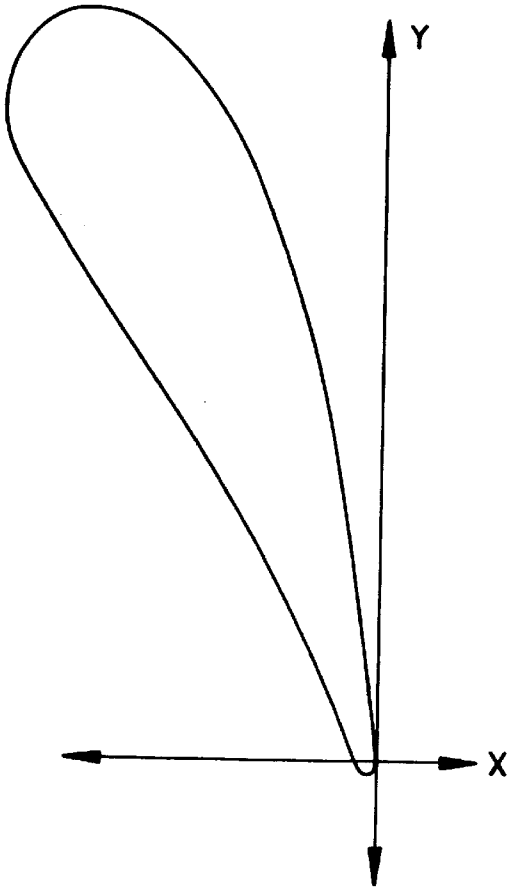

FIG. 7 illustrates the cross-sectional view of airfoil portion 7' taken along the hub portion of the vane 70. FIG. 8 illustrates the cross-sectional view of the airfoil portion 7" taken along the mid-height of the vane 70. FIG. 9 shows the cross-sectional view of the airfoil portion 7"' taken along the tip of the vane 70.

Tables I–III define the novel geometry of the vane 70 and airfoil portion 7', 7", and 7"'. In each table, the airfoil portion 7 is specified at three radial stations along the vane 70 specifically, at the hub portion 9 of the vane 70, at the mid-height, and at the tip portion 8 of the vane 70. In the preferred embodiment, the hub, mid-height and tip portions correspond to radii of 938.8, 1023.1, and 1106.4 respectively.

Figure 10:
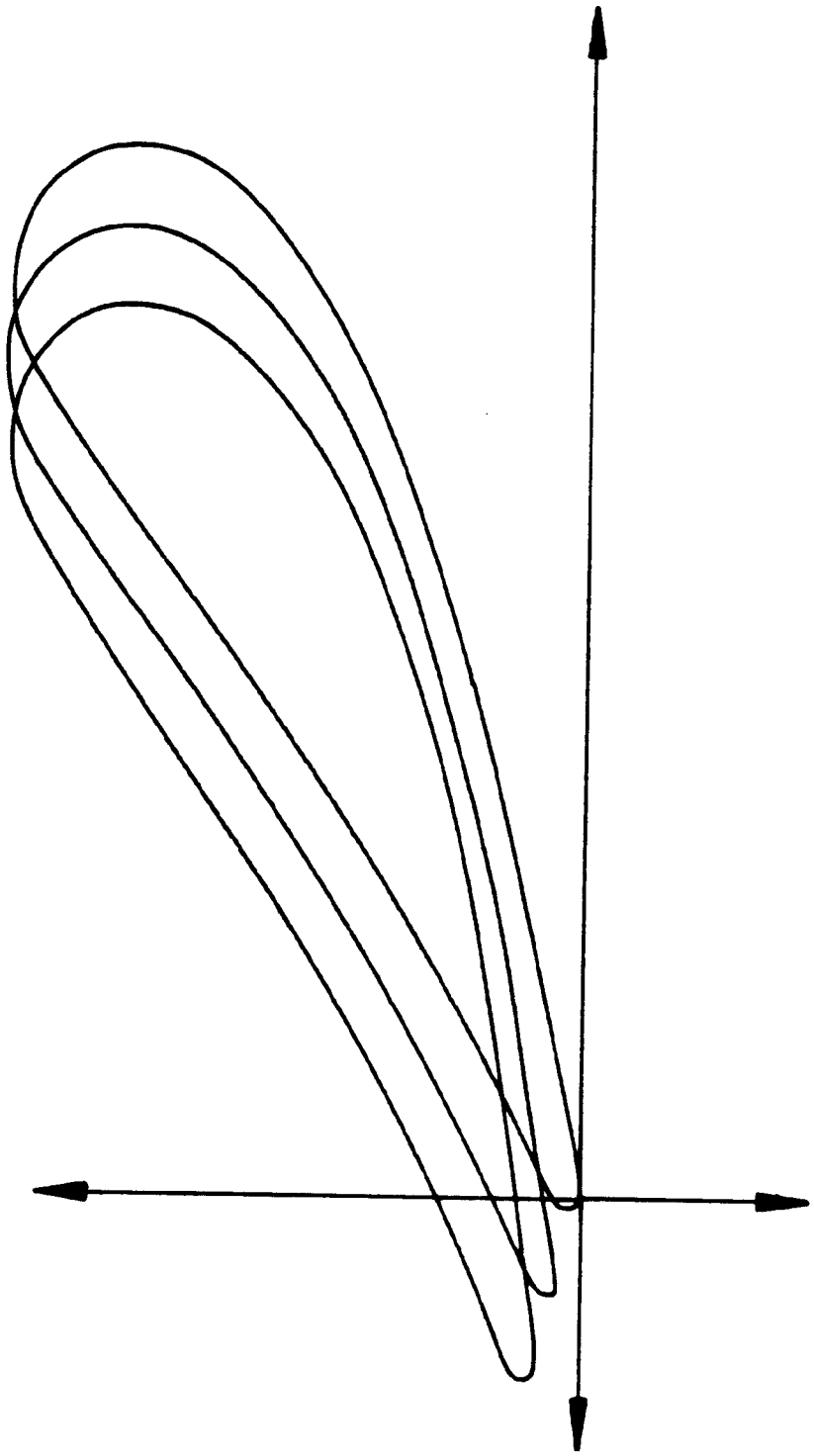
FIG. 10 is a superimposition of the cross-section shown in FIGS. 7–9, as they would be if projected onto a plane perpendicular to the radial direction.

FIG. 10 shows the cross-section shown in FIGS. 6–9 superimposed on one another. As those skilled in the art of vane and blade design will appreciate the values of the parameters shown in Tables I–III for the radial station at the tip of the airfoil is based on a projection of the airfoil cross-section out to the radial station at the trailing edge 44 of the tip portion. Such projection is necessary because the actual tip of the vane does not lie in a radial plane, tapering as it does toward the leading edge 42.

In Tables I and II, the vane 70 airfoil portion 7', 7", and 7"' are specified by reference to coordinates of the X and Y axes shown in FIG. 6. The X-Y coordinates of the 50 points along both the suction surface 46 and pressure surface 52 of the vane 70 and airfoil portion 7 define the shape of the vane 70 and airfoil portion 7 cross-section at each of the three aforementioned radial locations—the hub 9, mid-height, and tip 8 regions. It is noted that although the location coordinates shown in the Tables define a vane 70 and airfoil portions 7', 7", and 7"' of a particular size, depending on the units chosen (in the preferred embodiment, the units are in inches), the coordinates should be viewed as being essentially non-dimensional, since the invention could be practiced utilizing a larger or smaller vane 70 and airfoil portion 7 or a blade 5 having an airfoil portion 7, having the same shape, by appropriately scaling the coordinates so as to obtain multiples or fractions thereof—i.e., by multiplying each coordinate by a common factor.

TABLE I

AIRFOIL CONVEX SUCTION SURFACE X-Y COORDINATES

| Point | Hub | Mid-Height | Tip |
|---|---|---|---|
| 1 | (−101.31, 166.41) | (−108.68, 193.85) | (−116.05, 215.20) |
| 2 | (−99.41, 166.09) | (−106.71, 193.25) | (−113.95, 215.65) |
| 3 | (−97.30, 165.75) | (−104.44, 192.56) | (−111.52, 215.02) |
| 4 | (−95.23, 165.41) | (−102.24, 191.89) | (−109.15, 214.41) |
| 5 | (−93.15, 165.07) | (−100.01, 191.22) | (−106.76, 213.79) |
| 6 | (−91.07, 164.73) | (−97.79, 190.54) | (−104.37, 213.14) |
| 7 | (−88.90, 164.40) | (−95.56, 189.86) | (−101.97, 212.47) |
| 8 | (−86.90, 164.08) | (−93.34, 189.18) | (−99.56, 211.81) |
| 9 | (−84.83, 163.75) | (−91.12, 188.50) | (−97.15, 211.15) |
| 10 | (−82.75, 163.43) | (−88.89, 187.82) | (−94.75, 210.47) |
| 11 | (−80.67, 163.11) | (−86.67, 187.14) | (−92.33, 209.77) |
| 12 | (−78.59, 162.79) | (−84.45, 186.46) | (−89.91, 209.08) |
| 13 | (−76.52, 162.47) | (−92.22, 185.77) | (−87.50, 208.38) |
| 14 | (−74.43, 162.15) | (−78.00, 185.09) | (−85.08, 207.58) |
| 15 | (−72.49, 161.72) | (−77.78, 184.42) | (−82.66, 206.97) |
| 16 | (−70.44, 161.00) | (−75.57, 183.68) | (−80.25, 206.20) |
| 17 | (−68.30, 160.06) | (−73.38, 182.79) | (−77.85, 205.25) |
| 18 | (−66.26, 158.99) | (−71.18, 181.70) | (−75.45, 204.08) |
| 19 | (−64.20, 157,72) | (−68.97, 180.44) | (−73.03, 202.73) |
| 20 | (−62.14, 156.28) | (−66.77, 179.00) | (−70.62, 201.10) |
| 21 | (−60.08, 154.65) | (−64.56, 177.37) | (−68.20, 199.45) |
| 22 | (−58.02, 152.85) | (−62.35, 175.55) | (−65.79, 197.50) |
| 23 | (−55.95, 150.86) | (−60.13, 173.55) | (−63.36, 195.35) |
| 24 | (−53.89, 148.87) | (−57.92, 171.34) | (−60.53, 192.57) |
| 25 | (−51.82, 146.29) | (−55.70, 168.93) | (−58.51, 190.37) |
| 26 | (−49.76, 143.70) | (−53.49, 166.31) | (−56.08, 187.54) |
| 27 | (−47.69, 140.97) | (−51.27, 163.46) | (−53.65, 184.49) |
| 28 | (−45.62, 137.81) | (−49.06, 160.39) | (−51.22, 181.20) |
| 29 | (−43 56, 134 47) | (−46.84, 157.07) | (−48.79, 177.67) |
| 30 | (−41.47, 130.95) | (−44.62, 153.49) | (−46.36, 173.91) |
| 31 | (−39.42, 126.90) | (−42.40, 149.63) | (−43.93, 169.89) |
| 32 | (−37.35, 122.64) | (−40.18, 145.49) | (−41.50, 165.57) |
| 33 | (−35.29, 118.10) | (−37.96, 141.06) | (−39.07, 160.94) |
| 34 | (−33.22, 113.26) | (−35.75, 136.33) | (−36.64, 155.96) |
| 35 | (−31.16, 108.13) | (−33.53, 131.29) | (−34.22, 150.70) |
| 36 | (−29.01, 102.69) | (−31.31, 125.94) | (−31.79, 145.06) |
| 37 | (−27.04, 96.95) | (−29.10, 120.26) | (−29.37, 139.04) |
| 38 | (−24.98, 90.90) | (−26.86, 144.25) | (−25.95, 132.60) |
| 39 | (−22.92, 84.55) | (−24.67, 107.85) | (−24.53, 125.59) |
| 40 | (−20.66, 77.96) | (−22.46, 101.05) | (−22.12, 117.89) |
| 41 | (−18.81, 71.21) | (−20.25, 93.82) | (−19.69, 109.39) |
| 42 | (−16.76, 64.14) | (−19.04, 86.09) | (−17.45, 100.85) |
| 43 | (−14.70, 56.63) | (−15.83, 77.70) | (−15.54, 92.62) |
| 44 | (−12.65, 48.99) | (−13.62, 68.44) | (−13.64, 83.27) |
| 45 | (−10.61, 41.27) | (−11.42, 58.35) | (−11.52, 71.47) |
| 46 | (−8.56, 33.39) | (−9.21, 47.49) | (−9.11, 56.66) |
| 47 | (−6.51, 26.02) | (−7.00, 35.99) | (−6.70, 40.66) |
| 48 | (−4.47, 18.14) | (−4.90, 24.15) | (−4.31, 24.86) |
| 49 | (−2.42, 9.44) | (−2.60, 12.30) | (−1.90, 9.65) |
| 50 | (−0.40, 0.27) | (−.40, .21) | (−.40, .17) |

TABLE II

AIRFOIL CONCAVE SURFACE COORDINATES

| Point | Hub | Mid-Height | Tip |
|---|---|---|---|
| 1 | (−101.31, 134.67) | (−108.68, 153.05) | (−116.05, 171.43) |
| 2 | (−99.15, 131.44) | (−106.39, 149.72) | (−113.63, 168.02) |
| 3 | (−97.06, 128.28) | (−104.15, 146.48) | (−111.28, 164.70) |
| 4 | (−94.97, 125.10) | (101.93, 143.15) | (−108.93, 161.27) |
| 5 | (−92.89, 122.29) | (−99.71, 140.06) | (−105.58, 157.90) |
| 6 | (−90.80, 119.59) | (−97.49, 137.07) | (−104.23, 154.62) |
| 7 | (−68.72, 116.92) | (−95.27, 134.05) | (−101.86, 151.27) |
| 8 | (−86.64, 114.30) | (−93.05, 131.07) | (−99.50, 147.93) |
| 9 | (−84.57, 111.74) | (−90.83, 128.14) | (−97.14, 144.64) |
| 10 | (−82.49, 109.73) | (−88.61, 125.25) | (−94.78, 141.36) |
| 11 | (−80.42, 106.74) | (−85.39, 122.38) | (−92.42, 138.10) |
| 12 | (−78.35, 104.26) | (−84.17, 119.52) | (−90.05, 134.86) |
| 13 | (−76.27, 101.76) | (−81.96, 116.67) | (−87.69, 131.64) |
| 14 | (−74.20, 99.25) | (−79.75, 113.82) | (−85.32, 128.45) |
| 15 | (−72.13, 96.71) | (−77.53, 110.97) | (−82.92, 125.28) |

TABLE II-continued

| AIRFOIL CONCAVE SURFACE COORDINATES | | | |
|---|---|---|---|
| Point | Hub | Mid-Height | Tip |
| 16 | (−70.06, 94.15) | (−75.32, 108.12) | (−80.53, 122.12) |
| 17 | (−68.00, 91.56) | (−73.11, 105.26) | (−78.22, 118.97) |
| 18 | (−65.93, 88.94) | (−70.85, 102.38) | (−75.86, 115.83) |
| 19 | (−63.86, 86.30) | (−68.68, 99.50) | (−73.49, 112.69) |
| 20 | (−61.80, 83.63) | (−66.47, 96.60) | (−71.12, 109.54) |
| 21 | (−59.74, 80.95) | (−64.26, 93.68) | (−68.76, 106.37) |
| 22 | (−57.68, 78.26) | (−62.06, 90.74) | (−66.39, 103.17) |
| 23 | (−55.62, 75.54) | (−59.85, 87.78) | (−64.02, 98.95) |
| 24 | (−53.57, 72.81) | (−57.64, 84.80) | (−61.66, 96.70) |
| 25 | (−51.51, 70.07) | (−55.43, 81.79) | (−59.29, 93.42) |
| 26 | (−49.46, 67.30) | (−53.23, 78.76) | (−56.93, 90.11) |
| 27 | (−47.40, 64.52) | (−51.02, 75.70) | (−54.56, 86.77) |
| 28 | (−45.35, 61.72) | (−48.82, 72.61) | (−52.20, 83.38) |
| 29 | (−43.30, 58.92) | (−46.61, 69.49) | (−49.83, 79.95) |
| 30 | (−41.25, 56.10) | (−44.41, 66.34) | (−47.47, 76.46) |
| 31 | (−39.21, 53.26) | (−42.21, 63.15) | (−45.11, 72.91) |
| 32 | (−37.16, 50.42) | (−40.00, 59.92) | (−42.75, 69.29) |
| 33 | (−35.11, 47.55) | (−37.80, 56.65) | (−40.37, 65.60) |
| 34 | (−33.07, 44.66) | (−35.60, 53.33) | (−38.03, 61.85) |
| 35 | (−31.02, 41.72) | (−33.40, 49.96) | (−35.67, 58.05) |
| 36 | (−28.98, 38.74) | (−31.20, 46.55) | (−33.31, 54.19) |
| 37 | (−26.94, 35.70) | (−29.00, 43.07) | (−30.95, 50.29) |
| 38 | (−24.89, 32.60) | (−26.80, 39.53) | (−28.60, 46.30) |
| 39 | (−22.85, 29.45) | (−24.60, 35.92) | (−26.24, 42.23) |
| 40 | (−20.81, 26.23) | (−22.40, 32.22) | (−23.89, 38.04) |
| 41 | (−18.77, 22.94) | (−20.20, 28.42) | (−21.53, 33.74) |
| 42 | (−16.72, 19.57) | (−18.00, 24.52) | (−19.18, 29.30) |
| 43 | (−14.68, 16.14) | (−15.80, 20.50) | (−16.83, 24.70) |
| 44 | (−12.64, 12.62) | (−13.60, 16.35) | (−14.48, 19.92) |
| 45 | (−10.60, 9.01) | (−11.40, 12.06) | (−12.13, 14.96) |
| 46 | (−8.56, 5.32) | (−9.20, 7.62) | (−9.78, 9.78) |
| 47 | (−6.52, 1.54) | (−7.00, 3.04) | (−7.43, 4.43) |
| 48 | (−4.48, −2.23) | (−4.80, −1.70) | (−5.08, −1.16) |
| 49 | (−2.44, −6.26) | (−2.60, −6.50?) | (−2.74, −6.82) |
| 50 | (−.40, −10.16) | (−.40, −11.30) | (−.40, −12.48) |

The novel geometry of the airfoil 7 for the vane 70 of the current invention is further specified in Table III by reference to various parameters, each of which is discussed below and illustrated in FIGS. 7–9, that affect the performance and mechanical integrity of the vane (all angles in Table III are expressed in degrees).

TABLE III

| Parameter | Tip | Mid-Height | Hub |
|---|---|---|---|
| 1. Leading Edge Circle: | | | |
| a) radius | 22.71 | 24.70 | 26.58 |
| b) circle center | (−81.79, 150.05) | (−84.99, 163.51) | (−87.72, 175.83) |
| c) Suction Surface Blend Point | (−77.79, 172.41) | (−77.92, 187.18) | (−79.60, 201.14) |
| d) Pressure Surface Blend Point | (−100.61, 137.34) | (−105.36, 149.55) | (−109.51, 160.61) |
| 2. Trailing Edge Circle: | | | |
| a) radius | 2.91 | 2.40 | 2.90 |
| b) circle center | (−2.91, 2.22) | (−2.90, 2.10) | (−2.90, 1.99) |
| c) Suction Surface Blend Point | (−0.06, 2.80) | (−0.04, 2.60) | (−0.03, 2.44)0 |
| d) Pressure Surface Blend Point | (−5.51, 0.92) | (−5.53, 0.88) | (−5.57, 0.85) |
| 3. Inlet Blade Angle | −33.04 | −35.99 | −36.42 |

TABLE III-continued

| Parameter | Tip | Mid-Height | Hub |
|---|---|---|---|
| 4. Inlet Wedge Angle | 15.83 | 38.76 | 37.28 |
| 5. Outlet Blade Angle | −70.96 | −72.59 | −73.90 |
| 6. Outlet Wedge Angle | 15.01 | 14.63 | 14.11 |
| 7. Blade Area | 6160.72 | 7222.02 | 14.11 |
| 8. Center of Gravity | (−52.41, 106.12) | (−54.05, 115.85) | −55.48, 124.96 |
| 9. Perimeter | 421.78 | 455.73 | 487.08 |
| 10. Pitch at trailing edge | 184.61 | 118.47 | 217.20 |

Although the present invention has been illustrated with respect to a particular vane airfoil in a combustion turbine, the invention may be utilized in other vanes and blades of a combustion turbine. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A turbine section of a combustion turbine comprising an airfoil having a leading edge and a trailing edge defining an axial chord length therebetween, said airfoil further comprising a convex suction surface and a concave pressure surface intersecting at said leading edge and said trailing edge, said suction surface comprising an accelerating flow section and a decelerating flow section downstream of said accelerating flow section, said accelerating flow section formed such that a gas flow through said turbine section over said airfoil continues to accelerate over more than one half of said axial chord length, further comprising a film cooling perforations, formed in said accelerating flow section substantially upstream of said trailing edge including at least one of said film cooling perforations located downstream of a midpoint of said axial chord length, said perforation operable to enable a cooling film to be ejected into an accelerating gas flow stream.

2. The turbine of claim 1, wherein said at least one of said film cooling perforations is formed immediately upstream of a point $P_{max}$ defining the change from said accelerating flow section to said decelerating flow section.

3. The turbine of claim 1, said airfoil further comprising the following parameters:

TABLE III

| Parameter | Tip | Mid-Height | Hub |
|---|---|---|---|
| 1. Leading Edge Circle: | | | |
| a) radius | 22.71 | 24.70 | 26.58 |
| b) circle center | (−81.79, 150.05) | (−84.99, 163.51) | (−87.72, 175.83) |
| c) Suction Surface Blend Point | (−77.79, 172.41) | (−77.92, 187.18) | (−79.60, 201.14) |
| d) Pressure Surface Blend Point | (−100.61, 137.34) | (−105.36, 149.55) | (−109.51, 160.61) |
| 2. Trailing Edge Circle: | | | |
| a) radius | 2.91 | 2.40 | 2.90 |
| b) circle center | (−2.91, 2.22) | (−2.90, 2.10) | (−2.90, 1.99) |

TABLE III-continued

| Parameter | Tip | Mid-Height | Hub |
|---|---|---|---|
| c) Suction Surface Blend Point | (−0.06, 2.80) | (−0.04, 2.60) | (−0.03, 2.44)0 |
| d) Pressure Surface Blend Point | (−5.51, 0.92) | (−5.53, 0.88) | (−5.57, 0.85) |
| 3. Inlet Blade Angle | −33.04 | −35.99 | −36.42 |
| 4. Inlet Wedge Angle | 15.83 | 38.76 | 37.28 |
| 5. Outlet Blade Angle | −70.96 | −72.59 | −73.90 |
| 6. Outlet Wedge Angle | 15.01 | 14.63 | 14.11 |
| 7. Blade Area | 6160.72 | 7222.02 | 14.11 |
| 8. Center of Gravity | (−52.41, 106.12) | (−54.05, 115.85) | −55.48, 124.96 |
| 9. Perimeter | 421.78 | 455.73 | 487.08 |
| 10. Pitch at trailing edge | 184.61 | 118.47 | 217.20 |

4. The turbine of claim 1, said first airfoil further comprising the following parameters:

TABLE III

| Parameter | Tip | Mid-Height | Hub |
|---|---|---|---|
| 1. Leading Edge Circle: | | | |
| a) radius | 22.71 | 24.70 | 26.58 |
| b) circle center | (−81.79, 150.05) | (−84.99, 163.51) | (−87.72, 175.83) |
| c) Suction Surface Blend Point | (−77.79, 172.41) | (−77.92, 187.18) | (−79.60, 201.14) |
| d) Pressure Surface Blend Point | (−100.61, 137.34) | (−105.36, 149.55) | (−109.51, 160.61) |
| 2. Trailing Edge Circle: | | | |
| a) radius | 2.91 | 2.40 | 2.90 |
| b) circle center | (−2.91, 2.22) | (−2.90, 2.10) | (−2.90, 1.99) |
| c) Suction Surface Blend Point | (−0.06, 2.80) | (−0.04, 2.60) | (−0.03, 2.44)0 |
| d) Pressure Surface Blend Point | (−5.51, 0.92) | (−5.53, 0.88) | (−5.57, 0.85) |
| 3. Inlet Blade Angle | −33.04 | −35.99 | −36.42 |
| 4. Inlet Wedge Angle | 15.83 | 38.76 | 37.28 |
| 5. Outlet Blade Angle | −70.96 | −72.59 | −73.90 |
| 6. Outlet Wedge Angle | 15.01 | 14.63 | 14.11 |
| 7. Blade Area | 6160.72 | 7222.02 | 14.11 |
| 8. Center of Gravity | (−52.41, 106.12) | (−54.05, 115.85) | −55.48, 124.96 |
| 9. Perimeter | 421.78 | 455.73 | 487.08 |
| 10. Pitch at trailing edge | 184.61 | 118.47 | 217.20 |

5. A turbine section of a combustion turbine comprising a first airfoil and an adjacent second airfoil, each of said airfoils having a leading edge and a trailing edge defining an axial chord length therebetween, each of said airfoils further comprising a convex suction surface and a concave pressure surface intersecting at said leading edge and said trailing edge, each of said suction surfaces comprising an accelerating flow section and a decelerating flow section downstream of said accelerating flow section, wherein said first and said second adjacent airfoils define a throat between said trailing edge of said second airfoil and the nearest point on said suction surface of said first airfoil, said accelerating flow section of said first airfoil extending downstream of said throat, further comprising a film cooling perforations formed in said accelerating flow section of said first airfoil substantially upstream of said trailing edge including at least one of said film cooling perforations located downstream of said throat, said perforation operable to enable a cooling film to be ejected into an accelerating gas flow stream.

6. The turbine of claim 5, wherein said at least one film cooling perforation is formed immediately upstream of a point $P_{max}$ defining the change from said accelerating flow section to said decelerating flow section of said first airfoil.

7. The turbine of claim 5, said first airfoil further comprising the following parameters:

TABLE III

| Parameter | Tip | Mid-Height | Hub |
|---|---|---|---|
| 1. Leading Edge Circle: | | | |
| a) radius | 22.71 | 24.70 | 26.58 |
| b) circle center | (−81.79, 150.05) | (−84.99, 163.51) | (−87.72, 175.83) |
| c) Suction Surface Blend Point | (−77.79, 172.41) | (−77.92, 187.18) | (−79.60, 201.14) |
| d) Pressure Surface Blend Point | (−100.61, 137.34) | (−105.36, 149.55) | (−109.51, 160.61) |
| 2. Trailing Edge Circle: | | | |
| a) radius | 2.91 | 2.40 | 2.90 |
| b) circle center | (−2.91, 2.22) | (−2.90, 2.10) | (−2.90, 1.99) |
| c) Suction Surface Blend Point | (−0.06, 2.80) | (−0.04, 2.60) | (−0.03, 2.44)0 |
| d) Pressure Surface Blend Point | (−5.51, 0.92) | (−5.53, 0.88) | (−5.57, 0.85) |
| 3. Inlet Blade Angle | −33.04 | −35.99 | −36.42 |
| 4. Inlet Wedge Angle | 15.83 | 38.76 | 37.28 |
| 5. Outlet Blade Angle | −70.96 | −72.59 | −73.90 |
| 6. Outlet Wedge Angle | 15.01 | 14.63 | 14.11 |
| 7. Blade Area | 6160.72 | 7222.02 | 14.11 |
| 8. Center of Gravity | (−52.41, 106.12) | (−54.05, 115.85) | −55.48, 124.96 |
| 9. Perimeter | 421.78 | 455.73 | 487.08 |
| 10. Pitch at trailing edge | 184.61 | 118.47 | 217.20 |

* * * * *